US007173200B2

(12) United States Patent
Yoneyama

(10) Patent No.: US 7,173,200 B2
(45) Date of Patent: Feb. 6, 2007

(54) KEY SWITCH

(75) Inventor: Masayuki Yoneyama, Kanagawa (JP)

(73) Assignee: Minebea Co., Ltd., Kitasaku-gun (JP)

( * ) Notice: Subject to any disclaimer, the term of this patent is extended or adjusted under 35 U.S.C. 154(b) by 0 days.

(21) Appl. No.: 11/172,911

(22) Filed: Jul. 5, 2005

(65) Prior Publication Data

US 2006/0000695 A1 Jan. 5, 2006

(30) Foreign Application Priority Data

Jul. 5, 2004 (JP) ..... 2004-198013

(51) Int. Cl.
*H01H 9/26* (2006.01)
*H01H 13/72* (2006.01)
*H01H 13/76* (2006.01)

(52) U.S. Cl. ..... 200/5 A; 200/344; 200/345; 400/490; 400/495

(58) Field of Classification Search ..... 200/5 A, 200/517, 344, 345; 400/490, 491, 491.2, 400/495, 495.1, 496
See application file for complete search history.

(56) References Cited

U.S. PATENT DOCUMENTS

| | | | | |
|---|---|---|---|---|
| 5,488,210 | A * | 1/1996 | Shigetaka et al. | 200/344 |
| 5,746,308 | A * | 5/1998 | Lin | 200/344 |
| 6,909,062 | B2 * | 6/2005 | Narusawa et al. | 200/344 |
| 2002/0175063 | A1 * | 11/2002 | Ito et al. | 200/344 |

FOREIGN PATENT DOCUMENTS

| | | | |
|---|---|---|---|
| JP | 06-60769 | A | 3/1994 |
| JP | 8-124456 | A | 5/1996 |
| JP | 2003-297177 | A | 10/2003 |

* cited by examiner

*Primary Examiner*—Elvin Enad
*Assistant Examiner*—Lheiren Mae A. Anglo
(74) *Attorney, Agent, or Firm*—Foley & Lardner LLP

(57) ABSTRACT

A key switch includes a guiding and supporting mechanism for guiding and supporting a key top. The guiding and supporting mechanism is so constructed that a substantially ring-shaped stabilizer and a substantially U-shaped stabilizer are pivotally connected by shafts and bearing parts each having a semi-circular sectional shape.

11 Claims, 7 Drawing Sheets

KEY SWITCH

BACKGROUND OF THE INVENTION

1. Technical Field of the Invention

The present invention relates to a key switch which is incorporated in a keyboard as an I/O interface.

2. Description of the Related Art

The key switch to be incorporated in the keyboard is such a device that its size may not change with a view to conforming to a shape of a man's finger, for convenience of operating with the finger. Moreover, the key switch is the device that such features as satisfying the man's feeling of operation may be particularly required.

It is required for the key switch to ensure smooth up and down movements free from a backlash or inclination of a key top, and strokes capable of obtaining, during a pressing stroke, feeling of buckling or tactile feeling for the purpose of feeding back ON or OFF shift of a contact to the finger, feeling of depressing operation, and feeling of shifting the contact.

Particularly, the smooth up and down movements of the key top free from a backlash or inclination have been required. In the related art, as a guiding and supporting mechanism for that purpose, there have been often employed two link members which are pivotally connected to each other at substantially center parts thereof to be formed into a substantially X-shape. This guiding and supporting mechanism has been keenly required to reduce its height, in a notebook type rather than in a desktop type. Since the notebook type needs to be folded, it has been a potential problem to reduce an overall height of the guiding and supporting mechanism including the key top.

FIG. 6 is a sectional view of a related art key switch (Refer to JP-A-2003-297177, for example).

In FIG. 6, a holder 102 in a substantially π-shape is engaged with a back face of a key top 101 by means of locking hooks 103 and 104. Locking pins provided at ends of a guiding and supporting mechanism 105 are arranged between the key top 101 and the holder 102. When the key top 101 is depressed or released, the guiding and supporting mechanism 105 will be extended in a substantially X-shape or folded telescopically to be superposed, changing its height. Especially when the guiding and supporting mechanism 105 has been folded and superposed, the height remains as it is, which will be a serious problem.

The guiding and supporting mechanism 105 includes link members 108, 109 which are assembled into a substantially X-shape by means of a shaft 110 in a columnar shape and a bearing part 111 in a shape of a columnar groove for receiving the shaft. The link members 108, 109 respectively have connecting portions. One of the connecting portions 106 is held between the back face of the key top 101 and the holder 102 so as to slide freely, and the other connecting portion 107 is clamped between the back face of the key top 101 and the holder 102.

The guiding and supporting mechanism 105 is required to have strength because of necessity of receiving an operating force of the finger, and so, the shaft 110 and the bearing part 111 which are affected by the force have been unable to be made small in diameter from a viewpoint of strength. For this reason, when the key top 101 has been depressed to the lowest, and the guiding and supporting mechanism 105 has been folded into a rectilinear shape, it has been impossible to make the height of the guiding and supporting mechanism 105 smaller than the height of the bearing part 111 which bears the shaft 110 passed therethrough.

Under the circumstances, there has been proposed such a structure that instead of rotatably supporting the link members 108, 109 by the related art bearing mechanism including a circular (a perfect circle) shaft 110 and the bearing part 111 in a shape of a circular groove, the link members are rotatably supported by means of two heart-shaped projections which have smaller thickness than the circular shaft (Refer to JP-A-6-60769, for example).

FIGS. 7A to 7C show a structure of the guiding and supporting mechanism in a substantially X-shape which rotatably supports the link members by means of the two heart-shaped projections in the related art. FIG. 7A shows an outer link member in a U-shape provided with outer leg pieces, FIG. 7B shows an inner link member in a U-shape provided with inner leg pieces, and FIG. 7C shows the structure of the guiding and supporting mechanism in which both the leg pieces are assembled into the substantially X-shape.

The guiding and supporting mechanism 120 includes the outer link member 122 in a U-shape provided with the outer leg pieces 121*a*, 121*b*, and the inner link member 123 in a U-shape provided with the inner leg pieces 123*a*, 123*b*, which are assembled into the substantially X-shape.

A pair of the outer leg pieces 121*a*, 121*b* are provided with heart-shaped projections 125, 126 at different levels on their inner faces opposed to each other. The outer leg pieces 121*a* and 121*b* are connected by a connecting rod 129 which is provided at their one ends.

In the same manner, a pair of the inner leg pieces 123*a*, 123*b* are provided with heart-shaped projections 127, 128 at different levels on their outer faces opposed to each other. The inner leg pieces 123*a* and 123*b* are connected by a connecting rod 130 which is provided at their one ends.

These two link members are arranged in the substantially X-shape as shown in FIG. 7C, and the heart-shaped projections 125 to 128 of all the leg pieces 121*a*, 121*b*, 123*a*, 123*b* are brought into contact as shown in the drawing thereby to support the X-shape so as not to be collapsed.

Although the above described guiding and supporting mechanism includes the link members assembled into the substantially X-shape, there has been proposed another type of guiding and supporting mechanism in which the shafts are not employed. Instead of assembling the link members into the substantially X-shape, the link members having the same shape are arranged separately, and rotatably engaged with each other at their one ends so that the two link members may be inclined at a same inclination angle when a key top is depressed (Refer to JP-A-8-124456, for example).

In the typical guiding and supporting mechanisms in the above described related art too, a problem of reducing the height of the guiding and supporting mechanism has become more and more important. In the related art guiding and supporting mechanism 105, the height of the link members can be reduced when the guiding and supporting mechanism 105 has been folded, because they are rotatably connected by means of a shaft, specifically, the shaft 110 and the bearing part 111 in a circular shape. However, the height corresponding to the diameters of the shaft 110 and the bearing part 111 cannot be reduced, but remains as it is. Moreover, the holder 102 has been employed so as to be opposed to the key top 101, due to necessity of providing a mechanism for fixing or slidably guiding one of the connecting portions of the link members on the key top. This holder 102, however, has been an obstacle for reducing the overall height.

On the other hand, in the guiding and supporting mechanism in which the link members are rotatably supported by the heart-shaped projections 125 to 128 which have smaller thickness than the shafts in a circular shape, positions of a pair of the heart-shaped projections provided on the respective link members are staggered in a vertical direction. Specifically, the heart-shaped projection 126 of the outer leg piece 121*b* is at a higher position than the heart-shaped projection 128 of the inner leg piece 123*b*, and the heart-shaped projection 125 of the outer leg piece 121*a* is at a lower position than the heart-shaped projection 127 of the inner leg piece 123*a*.

In the guiding and supporting mechanism 120 as shown in FIG. 7C, when the outer link member 122 has been depressed, the heart-shaped projection 126 presses the heart-shaped projection 128 downward, but the heart-shaped projection 125 moves apart from the heart-shaped projection 127 without pressing it downward. As the results, in the inner link member 124, only the inner leg piece 123*b* will be depressed, while the inner leg piece 123*a* will not be directly depressed, but simply follow the movement by way of the connecting rod 130. Hence, a twisting force around a fixed shaft 131 will be exerted, and a prying phenomenon will occur between the inner leg piece 123*a* of the inner link member 124 and the outer leg piece 121*a* of the outer link member 122, which will hinder smooth up and down movements.

Moreover, when the finger is detached from the key top in a depressed state, the guiding and supporting mechanism 120 will be returned to an initial state by means of a return spring (not shown). On this occasion, the heart-shaped projection 125 presses the heart-shaped projection 127 upward, but the heart-shaped projection 126 will not press the heart-shaped projection 128, but will move apart from the heart-shaped projection 128.

Further, in the guiding and supporting mechanism in which the two link members are adapted to be inclined at the same inclination angle, the link members draw a circle and the key top also will draw a circle. For this reason, the guiding and supporting mechanism becomes inconvenient for use, because an unnecessary play corresponding to the circle is required in arranging the key tops, and movement of the key top will be misaligned with movement of the finger.

SUMMARY OF THE INVENTION

It is an object of the invention to provide a key switch of which overall height can be reduced, with a simple structure.

In order to attain the above described object, the invention adopts the following means for solution.

According to the invention, a guiding and supporting mechanism includes a substantially ring-shaped stabilizer and a substantially U-shaped stabilizer which are directly fixed to a back face of a key top, at their respective one ends, by means of locking hooks. Moreover, pivotal connection between the substantially ring-shaped stabilizer and the substantially U-shaped stabilizer is performed by shafts and bearing parts each having a semi-circular shape in cross section. More specific features will be described below.

(1) The key switch is characterized in that the guiding and supporting mechanism is so constructed that the substantially ring-shaped stabilizer and the substantially U-shaped stabilizer are pivotally connected by the shafts and the bearing parts each having a semi-circular shape in cross section.

(2) The key switch as described in the above item (1) is characterized in that the shafts are formed in a semi-cylindrical shape, and the bearing parts are formed in a shape of semi-circular groove.

(3) The key switch as described in the above item (1) is characterized in that the key top is provided with locking hooks on a back face thereof, wherein frame locking pins of the substantially ring-shaped stabilizer and locking pins of the substantially U-shaped stabilizer are engaged with the locking hooks.

(4) The key switch as described in the above item (3) is characterized in that frame bearing pins of the substantially ring-shaped stabilizer are engaged with fixed locking hooks, and slide pins of the substantially U-shaped stabilizer are guided through slide grooves.

Since the related art guiding and supporting mechanism has had the link members assembled in a substantially X-shape by means of the shafts and the bearing parts, when the guiding and supporting mechanism has been folded telescopically, the overall height has been determined by the shafts and the bearing parts if they have large diameters, even though other members except the shafts and the bearing parts have substantially no thickness. Thus, the overall height of the key switch has been unable to be reduced. This is only because the shafts and bearing parts having a sectional shape of perfect circle has been employed in the related art. According to the invention, it is possible to reduce the height of the guiding and supporting mechanism including the substantially ring-shaped stabilizer and the substantially U-shaped stabilizer, when it has been folded, by employing the shafts and the bearing parts having a semi-circular shape in cross section, and therefore, it is possible to reduce the height of the key switch, corresponding to the semi-circular shape of the shafts and the bearing parts.

Moreover, in the related art guiding and supporting mechanism in which two pairs of the heart-shaped projections are provided in a vertically staggered relation, one of the pairs of the heart-shaped projections are engaged with each other to be forcibly moved, while the other pair of the heart-shaped projections will not be engaged, but simply follow the movement. For this reason, a twisting force around a fixed shaft will be exerted, and a prying phenomenon will occur between the inner leg piece of the inner link member and the outer leg piece of the outer link member, which will hinder smooth up and down movements. However, because the shafts in a semi-circular shape and the bearing parts in a shape of semi-cylindrical groove are employed in the guiding and supporting mechanism according to (2) of the invention, occurrence of the prying phenomenon will be eliminated, and smooth rotation of the shafts can be obtained.

In order to fit the frame locking pins and the locking pins of the guiding and supporting mechanism to the key top, the holder has been necessary in the related art so that a sliding space may be formed besides a space for the key top, with a view to slidably guiding the frame locking pins and the locking pins. However, according to (3) of the invention, the guiding and supporting mechanism can be directly engaged with the locking hooks provided on the back face of the key top without the holder, and hence, the height of the key switch can be reduced by an amount corresponding to a height of the holder.

Out of the pins provided at the ends of the stabilizers of the guiding and supporting mechanism according to (4) of the invention, three pairs of the pins (the frame locking pins, frame bearing pins, and locking pins) are fixed in position, and the remaining one pair of the pins (the slide pins) are made slidable. Therefore, it is possible to pivotally connect the stabilizers even by employing the shafts and the bearing parts.

Figure 1:
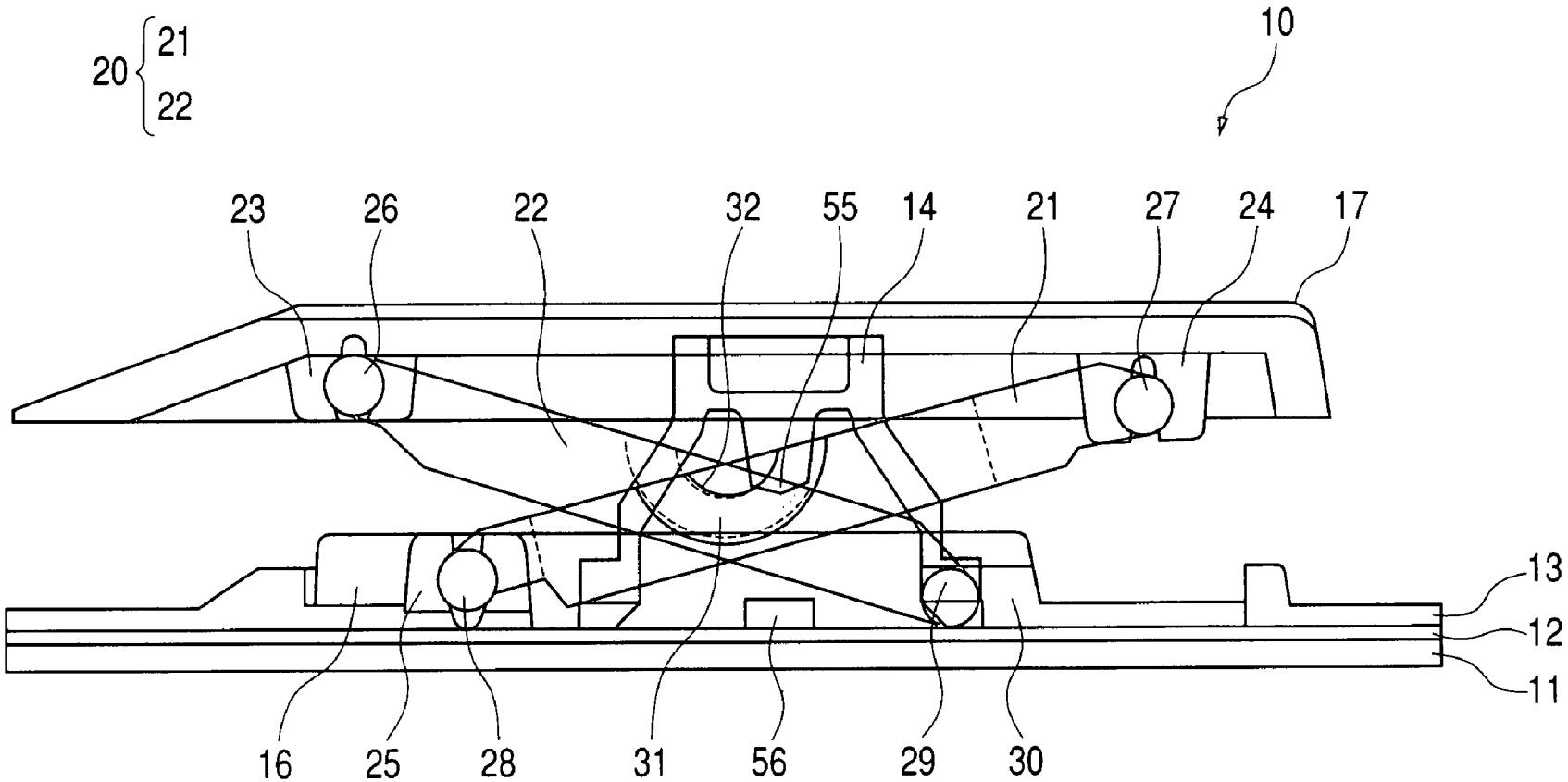
FIG. 1 is a sectional view of an essential part of stabilizers which are employed in a key switch of one embodiment according to the invention.

Reference numerals are used to identify various elements in the drawings including the following:

10 key switch
11 back plate
12 membrane sheet
13 support plate
14 rubber cap
16 keyboard frame
17 key top
20 guiding and supporting mechanism
21 substantially ring-shaped stabilizer
22 substantially U-shaped stabilizer
23, 23*a*, 23*b*, 24, 24*a*, 24*b*, 25 locking hook
26, 26*a*, 26*b* locking pin
27, 27*a*, 27*b* frame locking pin
28, 28*a*, 28*b* frame bearing pin
29, 29*a*, 29*b* slide pin
30 slide groove
31, 31*a*, 31*b* shaft
32, 32*a*, 32*b* bearing part
35*a*, 35*b* arm portion
36 connecting portion
37, 37*a*, 37*b* concave groove
38 opening
39*a*, 39*b* recess
41*a*, 41*b* frame arm portion
42 first connecting portion
43 second connecting portion
44*a*, 44*b* semi-columnar part
45, 45*a*, 45*b* semi-circular groove
46*a*, 46*b* concave groove

DETAILED DESCRIPTION OF THE INVENTION

An embodiment of a key switch according to the invention will be described in detail, referring to the drawings.

In the first place, (1) a summary of features of the invention will be explained, then, (2) a general structure of the key switch will be explained, and (3) other embodiments of pivotal support will be explained.

EMBODIMENT 1

FIG. 1 is a sectional view of the key switch according to the invention. FIG. 1 is a sectional view taken along a center line of the key switch, which is shown in perspective manner for convenience of explanation. In FIG. 1, the key switch is shown in a state returned to its initial state, in which a guiding and supporting mechanism is in an X-shape with its crossing angle spread.

As shown in FIG. 1, a key switch 10 includes a back plate 11 in a shape of flat plate formed of metal such as aluminum, a membrane sheet 12 placed on the back plate 11, a support plate 13 placed on this membrane sheet 12, a rubber cap (an elastic cap) 14 mounted on the membrane sheet 12, a keyboard frame 16 which is superposed on the support plate 13 to be fixed thereto, and provided with a rectangular opening for idly inserting the rubber cap 14, a key top 17 for depressing the rubber cap 14, and a guiding and supporting mechanism 20 in a substantially X-shape whose lower part is supported by the keyboard frame 16, and having link members which are pivotally assembled to each other substantially at center parts thereof so as to support the key top 17, and guide up and down movements of the key top.

The guiding and supporting mechanism 20 includes a substantially ring-shaped stabilizer 21 and a substantially U-shaped stabilizer 22 which are assembled into the substantially X-shape. Locking pins 26 and frame locking pins 27 provided at respective one ends of the stabilizers are rotatably held by locking hooks 23, 24 provided on a back face of the key top 17, without changing their positions. Frame bearing pins 28 provided at one of other ends of the two stabilizers are rotatably held by locking hooks 25 provided on the support plate 13 without changing their positions, and slide pins 29 at the other ends are slidably guided through slide grooves 30 which are formed between the keyboard frame 16 and the membrane sheet 12.

The locking hook is so constructed that a slit is formed at its center, and a round hole for grasping the locking pin is continuously formed in a part of the slit.

A shaft 31 in a semi-cylindrical shape and a bearing part 32 in a shape of a semi-circular groove for pivotally connecting the substantially ring-shaped stabilizer 21 and the substantially U-shaped stabilizer 22 are formed in a semi-circular shape in cross section having such a height as contained within the height of these substantially ring-shaped stabilizer 21 and the substantially U-shaped stabilizer 22.

In this manner, the locking pins 26 and the frame locking pins 27 at the respective one ends of the substantially ring-shaped stabilizer 21 and the substantially U-shaped stabilizer 22 of the guiding and supporting mechanism 20 are directly fitted to the back face of the key top 17 by means of the locking hooks 23, 24 at fixed positions. As the results, the height of the guiding and supporting mechanism will be reduced by an amount corresponding to the related art holder in a substantially π-shape which has become unnecessary. Moreover, because the substantially ring-shaped stabilizer 21 and the substantially U-shaped stabilizer 22 are pivotally connected by the shaft 31 and the bearing part 32 having the semi-circular sectional shape, a height of the shaft will be reduced to about one half, as compared with the shaft in a shape of a perfect circle in the related art, and hence, the overall height of the key switch can be reduced.

The reason why the shaft is formed to have the semi-circular sectional shape is as follows. In case where a diameter of the shaft having a sectional shape of a perfect circle has been reduced to a half, a cross sectional area of the shaft will be ¼, and only this area of ¼ will receive a pushing force, which will cause a lot of trouble. On the other hand, in case where the conventional shaft of a perfect circle has been cut to a half, the cross sectional area of the shaft will be ½, and the height will be the same as a half of the diameter of the aforesaid shaft having the sectional shape of a perfect circle. For this reason, in case where the related art shaft of a perfect circle has been cut to a half, there is a merit that the height will be a half of the related art shaft, while the cross-sectional area for receiving the pushing force can be kept as large as about ½, which would be sufficient, in strength, to bear the pushing force. From the above described viewpoint, it would be advantageous to cut the shaft into the semi-circular shape in cross section. The inventor has found that in case where the shaft has been cut into a semi-circular sectional shape, the shaft having a semi-cylindrical sectional shape has no problem in strength. The invention is based on this finding to construct the key switch.

Constituent elements of the key switch according to the invention as described above will be further explained, referring to FIGS. 2A to 2G and 3H to 3O.

Figure 2A:
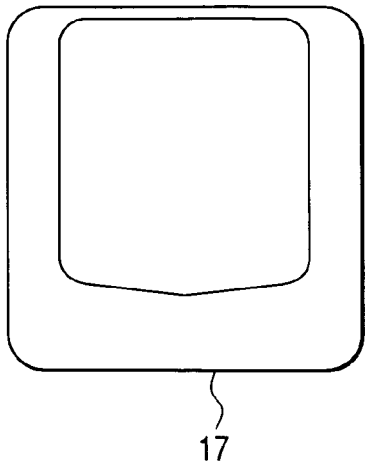
FIGS. 2A to 2G are structural views for explaining constituent elements in respective parts of the key switch of one embodiment according to the invention.
Figure 2B:
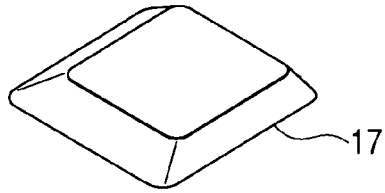
Figure 2C:
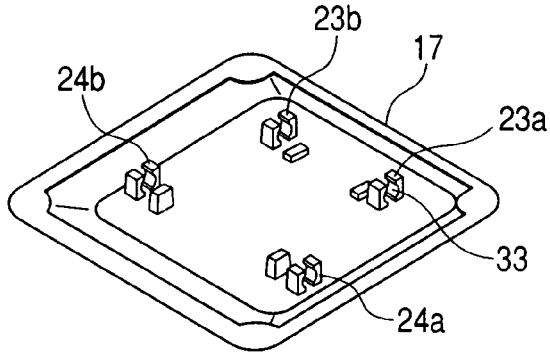
Figure 2D:
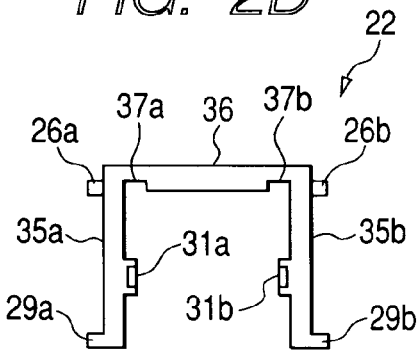
Figure 2E:
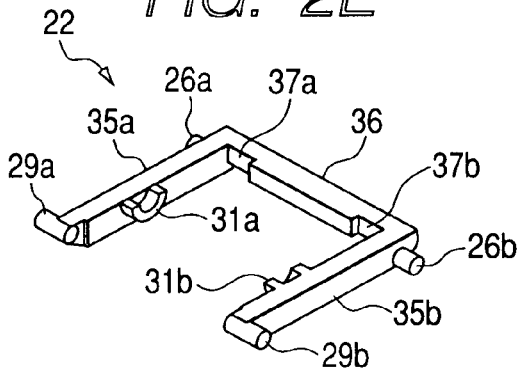
Figure 2F:
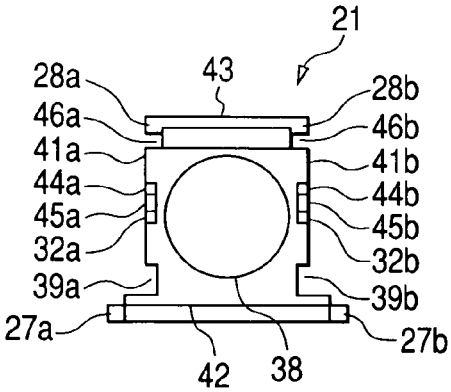
Figure 2G:
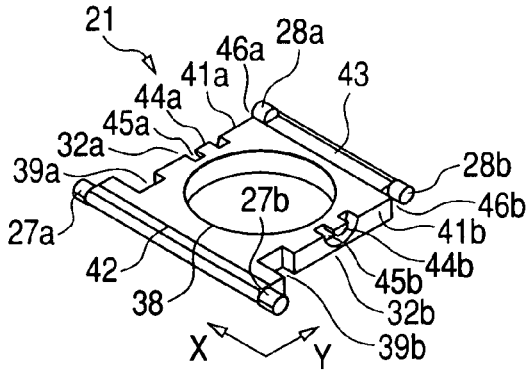

FIGS. 2A to 2G are structural views for explaining each of the constituent elements of the key switch according to the invention. FIG. 2A is a plan view of the key top, FIG. 2B is a perspective view of the key top, and FIG. 2C is a back side view of the key top. FIG. 2D is a plan view of the substantially U-shaped stabilizer of the guiding and supporting mechanism, FIG. 2E is a perspective view of the substantially U-shaped stabilizer, FIG. 2F is a plan view of the substantially ring-shaped stabilizer of the guiding and supporting mechanism, and FIG. 2G is a perspective view of the substantially ring-shaped stabilizer.

Figure 3H:
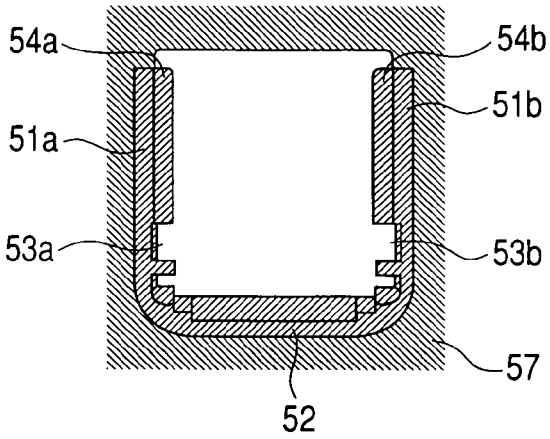
FIGS. 3H to 3O are structural views for explaining constituent elements in respective parts of the key switch of one embodiment according to the invention.
Figure 3I:
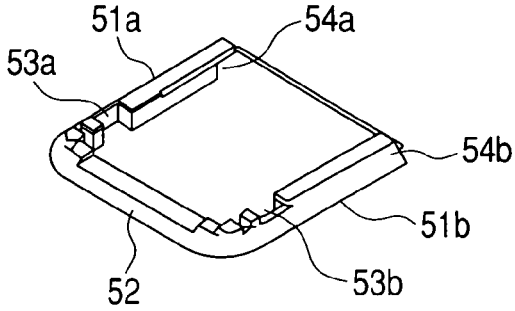
Figure 3J:
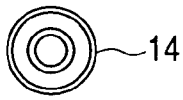
Figure 3K:
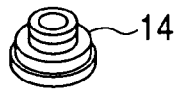
Figure 3L:
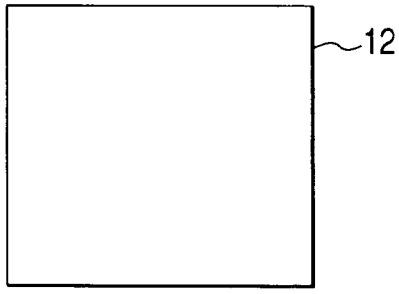
Figure 3M:
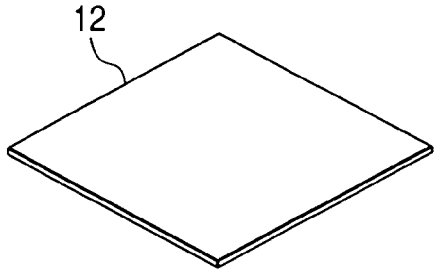
Figure 3N:
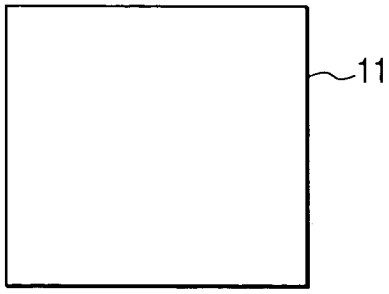
Figure 3O:
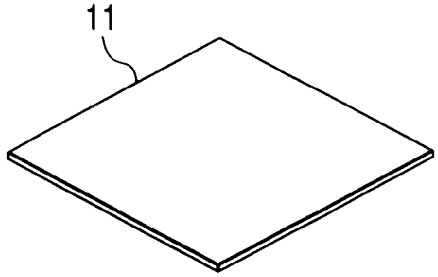

FIGS. 3H to 3O are structural views, showing each of the constituent elements of the key switch according to the invention. FIG. 3H is a plan view of the keyboard frame, FIG. 3I is a perspective view of the keyboard frame, FIG. 3J is a plan view of the rubber cap, FIG. 3L is a plan view of the membrane sheet, FIG. 3M is a perspective view of the membrane sheet, FIG. 3N is a plan view of the back plate, and FIG. 3O is a perspective view of the back plate.

The key top in FIGS. 2A to 2C are formed of synthetic resin such as ABS resin, and characters and so on are applied to an upper face thereof by stamping or printing. As shown in FIG. 2C, the key top 17 is provided, on a back face thereof, with four locking hooks 23*a*, 23*b*, 24*a*, 24*b* respectively having openings 33 which open in the same direction. Each of the locking hooks 23*a*, 23*b*, 24*a*, 24*b* is formed in a U-shape having a slit so as to grasp the pin.

Figure 5A:
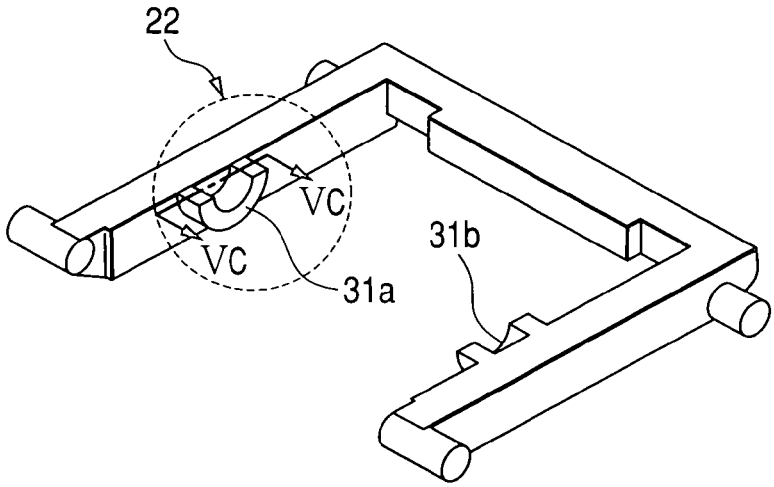
FIGS. 5A to 5C are views for describing other embodiments of the guiding and supporting mechanism according to the invention.
Figure 5B:
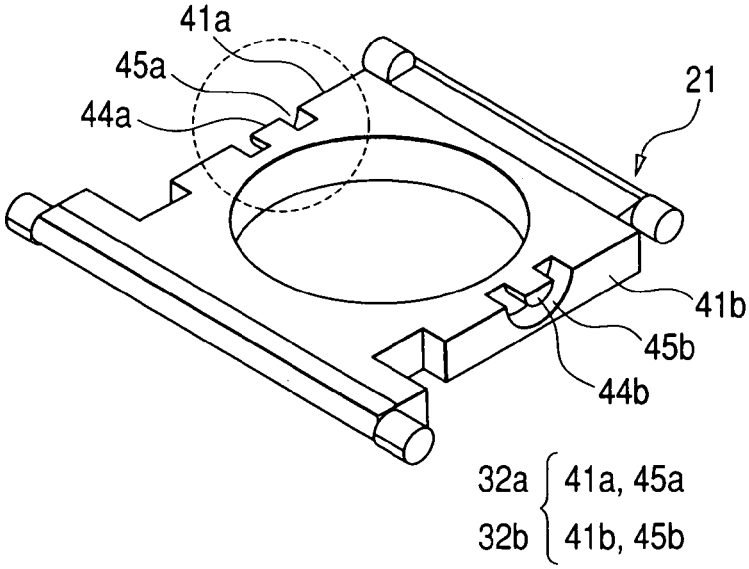

The guiding and supporting mechanism in FIGS. 2D to 2G includes the substantially ring-shaped stabilizer 21 and the substantially U-shaped stabilizer 22 which are pivotally connected by shafts 31*a*, 31*b* and bearing parts 32*a*, 32*b*, and assembled into the substantially X-shape. The guiding and supporting mechanism is also shown in FIGS. 5A and 5B in an enlarged scale.

In FIGS. 2D and 2E, the substantially U-shaped stabilizer 22 is formed in a U-shape by connecting arm portions 35*a* and 35*b* on both sides by means of a connecting portion 36. The connecting portion 36 is provided with a concave groove 37*a* and a concave groove 37*b* at both ends of its face opposed to the shafts 31*a*, 31*b*. These concave grooves 37*a* and 37*b* define spaces for receiving the locking hooks 25 for locking frame bearing pins 28*a* and 28*b* of the substantially ring-shaped stabilizer 21. The arm portion 35*a* is provided with an outwardly projecting locking pin 26*a* in a columnar shape at a position adjacent to a junction with the connecting portion 36, and also with a slide pin 29*a* in a columnar shape projected from a free end thereof. The arm portion 35*a* is further provided with a shaft 31*a* in a semi-cylindrical shape projected at a side opposite to the locking pin 26*a* and the slide pin 29*a*. A position of the shaft 31*a* in the arm portion 35*a* will be determined by calculation of an entirety of the guiding and supporting mechanism.

The arm portion 35*b* including a locking pin 26*b*, a slide pin 29*b* and the shaft 31*b* has the same structure as the arm portion 35*a*.

In FIGS. 2F and 2G, the substantially ring-shaped stabilizer 21 includes a flat plate having a substantially rectangular shape which is formed with an opening 38 for loosely inserting the rubber cap 14 at a center part thereof. Two opposed edges of the flat plate are provided with the bearing parts 32*a*, 32*b* and recesses 39*a*, 39*b* on outer faces thereof, and remaining two edges are provided with frame locking pins 27*a*, 27*b* and the frame bearing pins 28*a*, 28*b* separately. More specifically, the substantially ring-shaped stabilizer 21 is formed in a substantially box-like shape, by connecting a frame arm portion 41*a* and a frame arm portion 41*b* at both sides by means of a first frame connecting portion 42 and a second frame connecting portion 43. The frame arm portions 41*a*, 41*b* are respectively provided with the bearing parts 32*a*, 32*b* and recesses 39*a*, 39*b*, on the outer faces thereof. The first frame connecting portion 42 is provided with the frame locking pins 27*a*, 27*b* projected from both ends thereof, and the second frame connecting portion 43 is provided with the frame bearing pins 28*a*, 28*b* projected from both ends thereof. The aforesaid opening 38 may be formed in any desired shape, for example in a quadrangle, provided that the rubber cap 14 may be idly inserted into the opening.

The bearing parts 32*a*, 32*b* are respectively formed of semi-circular grooves 45*a*, 45*b* which are provided so as to open in two side faces of the frame arm portion 41*a* and the frame arm portion 41*b*. As the results, the semi-circular grooves 45*a*, 45*b* are so formed as to form semi-columnar parts 44*a*, 44*b* within thicknesses of the frame arm portions 41*a*, 41*b*, considering the strength. The recesses 39*a*, 39*b* are formed near the first frame connecting portion 42.

The first frame connecting portion 42 is formed longer in an X direction (in a direction of an arrow mark X in FIG. 2G; that is, the direction in which the frame arm portion 41*a* is connected to the frame arm portion 41*b*, for example) by a length corresponding to the thickness of the arm portions 35*a*, 35*b* of the substantially U-shaped stabilizer 22 so that the first frame connecting portion 42 can smoothly move, when the substantially U-shaped stabilizer 22 is arranged outside the substantially ring-shaped stabilizer 21 in a state where the guiding and supporting mechanism has been superposed telescopically.

The second connecting portion 43 is provided with concave grooves 46*a*, 46*b* at respective one sides of the frame bearing pins 28*a*, 28*b*, so as to define the frame bearing pins 28*a*, 28*b*. The locking hooks 25 are inserted into these concave grooves 46*a*, 46*b* thereby to lock the frame bearing pins 28*a*, 28*b*.

The keyboard frame 16 in FIGS. 3H and 3I includes a frame body in a substantially U-shape formed of a sheet of plate 57 so as to support and guide a plurality of the guiding and supporting mechanisms 20 corresponding to the number of the key switches. The keyboard frame 16 is placed on a part of the membrane sheet 12 and the support plate 13 (not shown in FIGS. 3H to 3O; See FIG. 1).

The keyboard frame 16 includes both side edges 51*a*, 51*b* and a connecting edge 52 which connects the side edges 51*a*, 51*b*. Both the side edges 51*a*, 51*b* are provided with cutout grooves 53*a*, 53*b* and sliding steps 54*a*, 54*b* which are separately formed on inner faces thereof from junctions with the connecting edge 52 toward their free ends. The cutout grooves 53*a*, 53*b* are formed vertically with respect to the keyboard frame 16, and define spaces for receiving locking hooks 23 which lock the locking pins 26*a*, 26*b* of the substantially U-shaped stabilizer 22. The sliding steps 54*a*, 54*b* are formed as stepped parts having an L-shape in cross section, and form the slide grooves 30 in a U-shape in cross section in combination with the membrane sheet 12 underlying. As shown in FIG. 1, the slide pins 29*a*, 29*b* of the substantially U-shaped stabilizer 22 are inserted through the slide grooves 30. An area of the membrane sheet 12 to be used as the slide grooves 30 is a part of a wiring face thereof where the wiring is not provided.

The support plate 13 which is placed on the membrane sheet 12 has an opening for providing the rubber cap 14 or the like. The keyboard frame 16 is mounted on the support plate 13 so as to stride across the opening.

The support plate 13 is provided with the locking hooks 25 for locking the frame bearing pins 28*a*, 28*b* of the substantially ring-shaped stabilizer 21. The locking hooks 25 protrude into the opening in the support plate 13.

The rubber cap (the elastic cap) 14 in FIGS. 3J and 3K, is formed in a shape of a cap (a hat without a rim, or a cup shape) out of insulating rubber such as silicone rubber or resin. The rubber cap 14 includes a tubular top portion projecting upward from a top of the cap, a skirt portion extending downwardly from a periphery of the tubular top portion, and a thick-walled flange portion extending from a lower end of the skirt portion so as to open downward, all of which are integrally formed. The rubber cap 14 is provided with a pushing projection integrally formed inside the top portion of the cap so as to protrude downwardly, and a movable electrode 55 (See FIG. 1) formed of an electrically conductive film printed on a tip end of the pushing projection.

The rubber cap 14 is positioned so that the movable electrode 55 may be opposed to a fixed electrode 56, and a bottom face of the rubber cap 14 is bonded to an upper face of the membrane sheet 12.

The membrane sheet in FIGS. 3L and 3M is in a form of a type of flexible printed circuit board (FPC) which includes a transparent and insulating base sheet formed of a resin film such as polyethylene terephthalate or polyester, and an electrically conductive pattern of electrically conductive ink, for example, a fixed electrode or a wiring which is formed on the base sheet by screen printing or the like.

Essentially, the electrically conductive pattern is composed of a pair of fixed electrodes of various shapes and a wiring pattern connected thereto, although the electrically conductive pattern may take various shapes according to an overall shape and specifications of the switch for the keyboard.

The guiding and supporting mechanism 20 is mounted on the membrane sheet 12 directly or interposing a resist film according to necessity.

As shown in FIG. 1, the slide pins 29 of the guiding and supporting mechanism 20 are slidably guided between the sliding steps 54*a*, 54*b* (see FIG. 3I) of the keyboard frame 16 and the membrane sheet 12. In other words, the slide pin 29 slides along the face of the membrane sheet 12 provided with the wiring. The frame bearing pins 28 of the guiding and supporting mechanism 20 are rotatably held by means of the locking hooks 25.

In this manner, the guiding and supporting mechanism 20 can be mounted on the membrane sheet 12 directly without interposing an insulating sheet, or alternatively, interposing a resist film.

The back plate 11 in FIGS. 3N and 3O is formed of a flat plate of metal such as aluminum.

(Operation)

Then, referring to FIG. 4, operation of the key switch will be described.

Figure 4A:
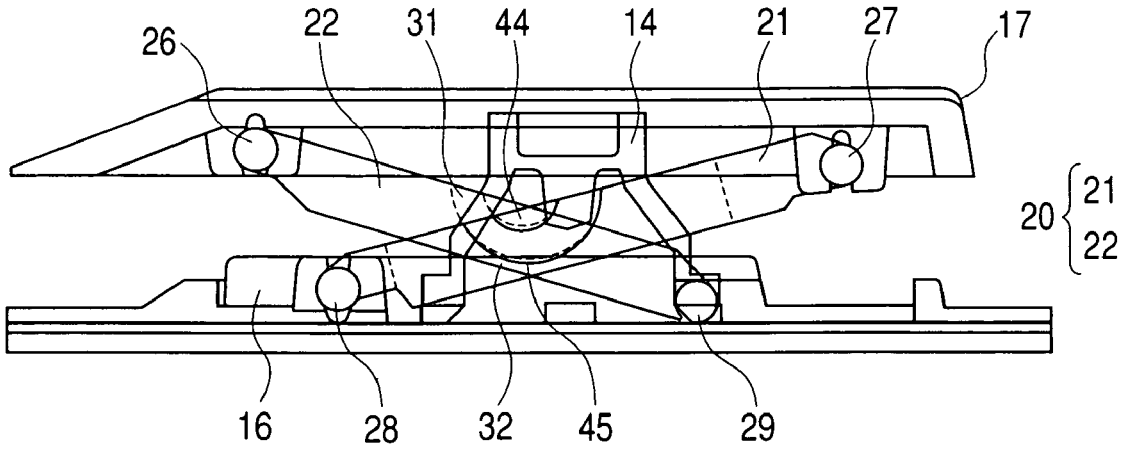
FIGS. 4A to 4C are views for explaining motions of a guiding and supporting mechanism according to the invention, in order of pressing strokes.
Figure 4B:
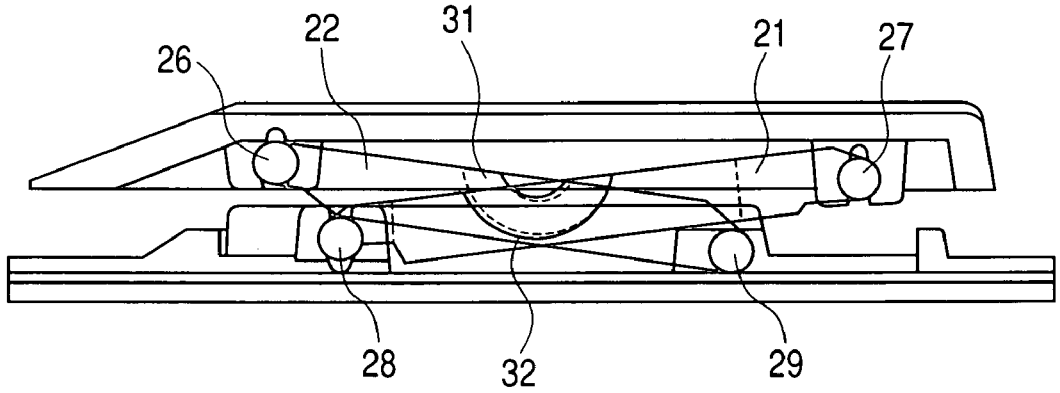
Figure 4C:
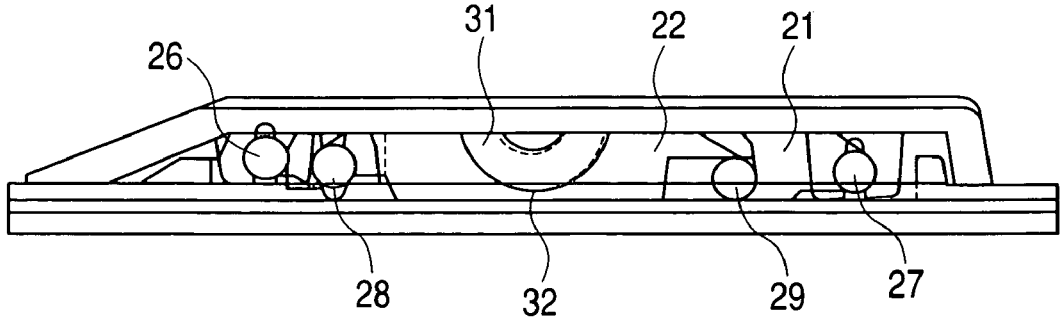

FIGS. 4A to 4C are explanatory views for explaining motions of the guiding and supporting mechanism in order of pressing strokes.

FIG. 4A is a sectional view similar to FIG. 1, showing the key switch in a state returned to the initial state, FIG. 4B is a sectional view in a state where the rubber cap is in buckling motion during depressing operation of the key top, and FIG. 4C is a sectional view in a state where the key switch has stopped at a final stage of a depressing stroke during the depressing operation.

The substantially U-shaped stabilizer 22 is arranged outside the substantially ring-shaped stabilizer 21, having the semi-cylindrical shafts 31 of the substantially U-shaped stabilizer 22 loosely inserted in semi-circular grooves 45 of the substantially ring-shaped stabilizer 21. The slide pins 29 are guided into the slide grooves 30 which are formed by combining the sliding steps 54*a*, 54*b* of the keyboard frame 16 and the underlying membrane sheet 12, the frame bearing pins 28 are engaged with the locking hooks 25 of the support plate 13, the locking pins 26 are engaged with the locking hooks 23 on the back face of the key top 17, and the frame locking pins 27 are engaged with the locking hooks 24 on the back face of the key top 17, whereby the two stabilizers 21, 22 are assembled into the substantially X-shape, as shown in FIG. 4A. The returned state can be maintained by returning force of the rubber cap 14.

By depressing the key top 17 from the state in FIG. 4A, the guiding and supporting mechanism 20 in the substantially X-shape will be gradually folded. At the same time, the top portion of the rubber cap 14 will be pushed downward, and the skirt portion of the rubber cap 14 will be deformed and subjected to buckling. Tactile feeling will be created by this buckling motion. Coincidentally, the movable electrode will bridge the first and second fixed electrodes to electrically connect them, thereby to come into a switched state, as shown in FIG. 4B. Thereafter, the pushing force during the aforesaid buckling motion continues to work, and the guiding and supporting mechanism 20 will be shifted from the state in FIG. 4B to the state in FIG. 4C, at once. In the state of FIG. 4C, the substantially U-shaped stabilizer 22 is arranged outside the substantially ring-shaped stabilizer 21 in a telescopically superposed manner.

In the state of FIG. 4C, the shafts 31, the bearing parts 32, and all the pins 26 to 29 are contained within the height of the two stabilizers 21, 22. Because the height of the shaft 31 and the bearing parts 32 has become a half, as compared with the related art case of a perfect circle, the height of the two stabilizers 21, 22 can be also reduced to a half. In addition, the holder which has been attached to the key top 17 in the related art is eliminated, and hence, the overall height can be reduced as much.

Because the frame locking pins 27 and the frame bearing pins 28 of the substantially ring-shaped stabilizer 21, and the locking pins 26 of the substantially U-shaped stabilizer 22 are fixed in position, while the slide pins 29 of the substantially U-shaped stabilizer 22 are so designed as to be changed in position, positional displacements will occur between respective center positions of the shafts 31 and the bearing parts 32. The diameter of the shafts 31 and the diameter of the semi-circular grooves of the bearing parts 32 are so determined that they have a play relative to each other, permitting more or less movements in a horizontal direction (a sliding direction of the slide pins).

EXAMPLE 2

Figure 5C:
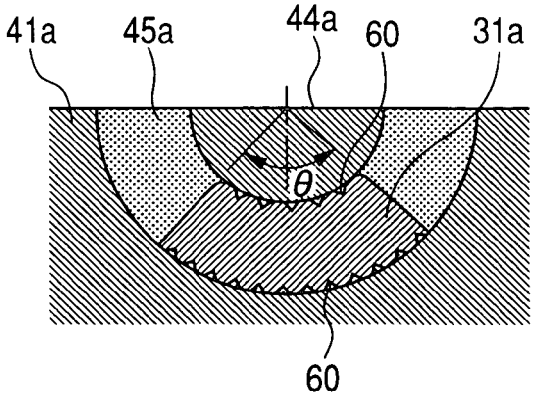
Figure 6:
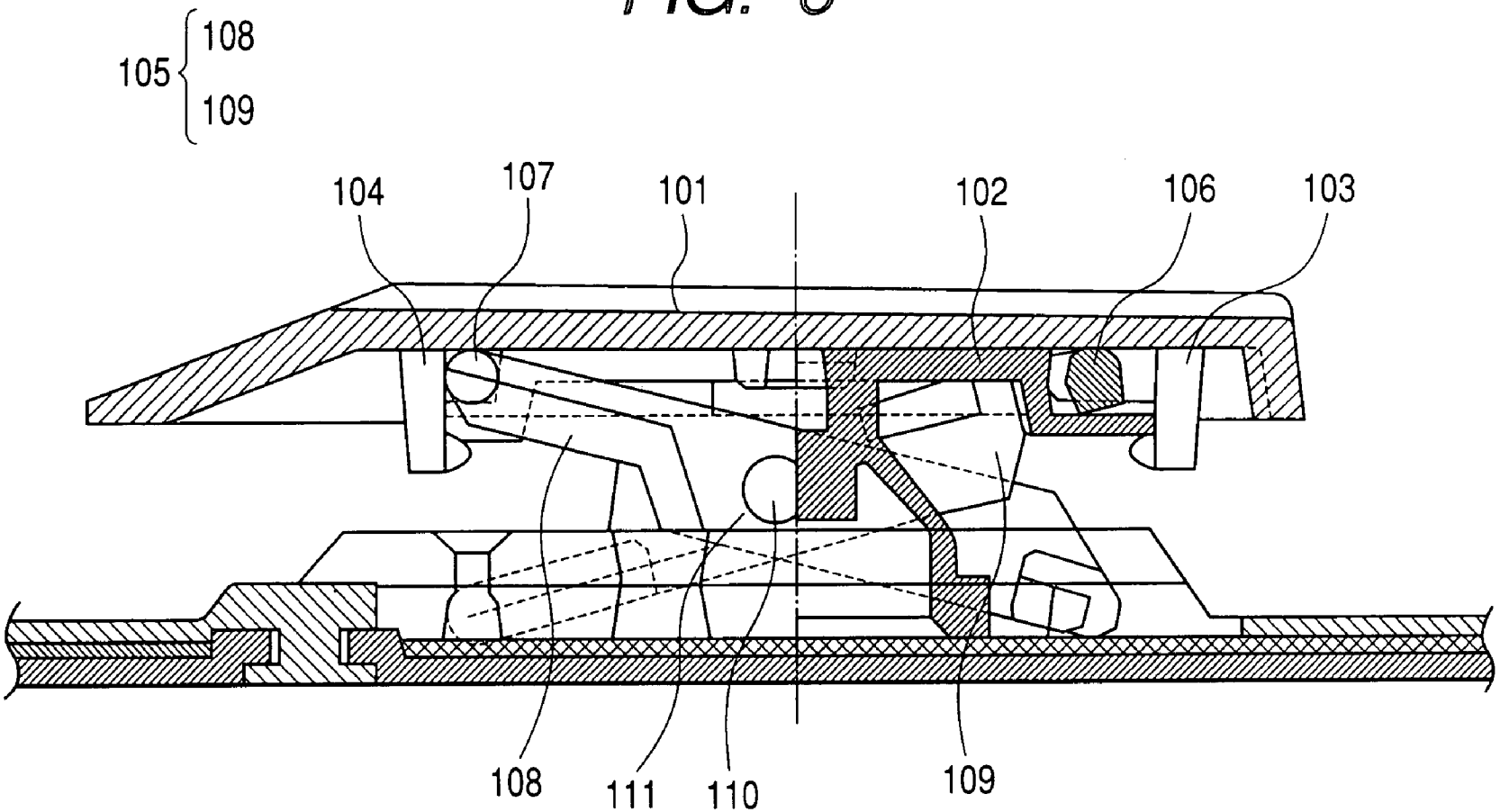
FIG. 6 is a sectional view of a related art key switch.
Figure 7A:
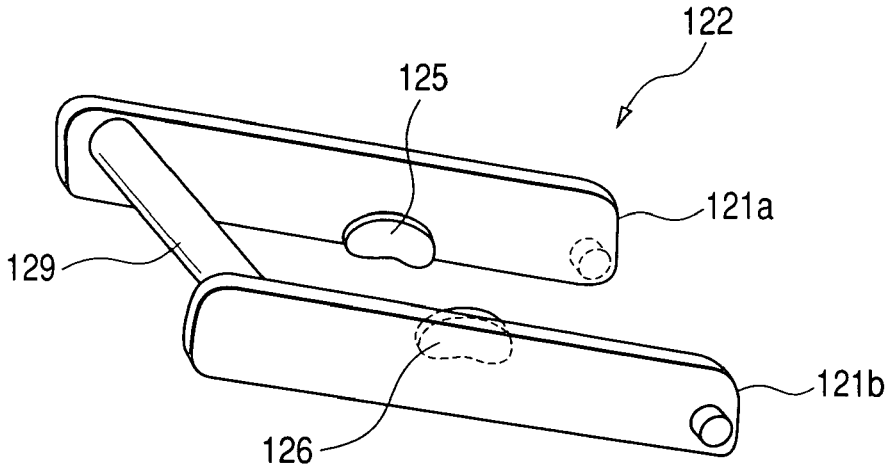
FIGS. 7A to 7C are structural views of a related art guiding and supporting mechanism in a substantially X-shape which is rotatably supported by means of two heart-shaped projections.
Figure 7B:
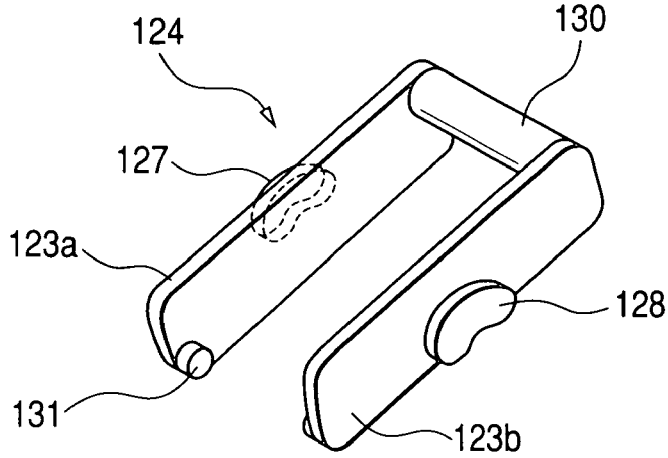
Figure 7C:
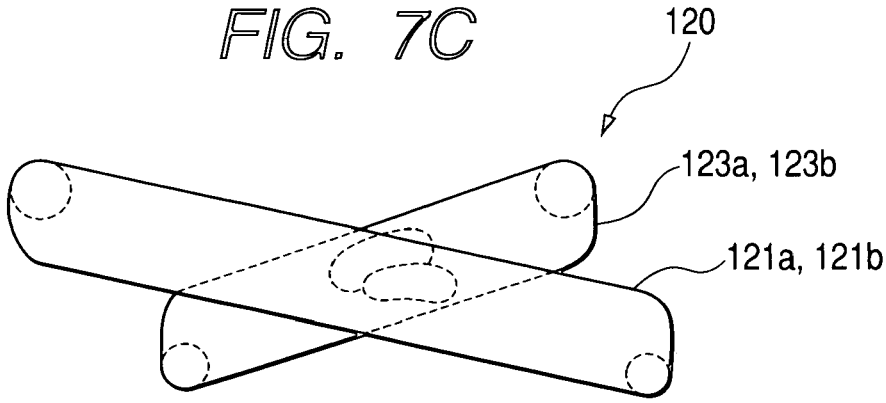

FIGS. 5A to 5C show another embodiment of the guiding and supporting mechanism according to the invention. In this embodiment, modification has been made, as shown in FIG. 5C, so that a shaft of the substantially U-shaped stabilizer encircled in FIG. 5A may be applied to a semi-circular groove of the substantially ring-shaped stabilizer encircled in FIG. 5B. FIG. 5C is a sectional view (the sectional view taken along a line VC—VC in FIG. 5A) in a state where the shaft and the bearing part are assembled.

The shaft in Embodiment 1 is shown by way of an example having a central angle of 180 degrees. While the guiding and supporting mechanism 20 is deformed from the substantially X-shape in the returned state, to the flat state in which it is telescopically superposed, rotation angles of the shafts 31*a*, 31*b* of the guiding and supporting mechanism 20 will change by about 45 degrees. In order that the shafts may be guided by the bearing parts in spite of such change in the rotation angle by about 45 degrees, it would be sufficient that the shaft has a central angle from 90 degrees (45 degrees each at both sides) to 180 degrees with respect to the semi-circular groove. FIG. 5C shows an example in which the central angle is 90 degrees in cross section.

EMBODIMENT 3

In order to minimize contact areas between the shafts 31*a*, 31*b* and the semi-circular grooves 45*a*, 45*b* of the bearing parts 32, irregularities 60 may be formed on the surfaces of the shafts 31*a*, 31*b*, as shown in FIG. 5C. With these irregularities 60, contact resistance can be reduced, and hence, a prying phenomenon can be prevented. As the results, operating force can be decreased.

EMBODIMENT 4

The shaft and the bearing parts may be appropriately provided in either of the substantially ring-shaped stabilizer and the substantially U-shaped stabilizer.

The invention contains a technical concept of reducing the height of the guiding and supporting mechanism, by so designing the shafts and the bearing parts as to have the semi-circular sectional shapes, and the invention can be applied to any apparatus which has a limit in height.

This application claims priority from Japanese Patent Application 2004-198013, filed Jul. 5, 2004, which is incorporated herein by reference in its entirety.

What is claimed is:

1. A key switch, comprising:

a key top; and a guiding and supporting mechanism for guiding and supporting the key top, wherein the guiding and supporting mechanism has a mechanism that a substantially ring-shaped stabilizer and a substantially U-shaped stabilizer are pivotally connected by a shaft and a bearing part each having a semi-circular shape in cross section, wherein the shaft has a semi-cylindrical shape and the bearing part has a semi-circular groove, and wherein the semi-circular groove does not pass through, in a depth direction of the semi-circular groove, a member on which the semi-circular groove is formed and which is a part of the substantially ring-shaped stabilizer or the substantially U-shaped stabilizer.

2. The key switch according to claim 1, wherein the key top has locking hooks on a back face thereof, the substantially ring-shaped stabilizer has frame locking pins, the substantially U-shaped stabilizer has locking pins, and the frame locking pins and the locking pins are engaged with the locking hooks.

3. The key switch according to claim 2, further comprising a support plate supporting the substantially ring-shaped stabilizer and the substantially U-shaped stabilizer and including fixed locking hooks and slide grooves, wherein the substantially ring-shaped stabilizer further comprises frame bearing pins engaged with the fixed locking hooks, and the substantially U-shaped stabilizer further comprises slide pins guided through the slide grooves.

4. A key switch, comprising:

a key top; and a guiding and supporting mechanism for guiding and supporting the key top comprising a first stabilizer and a second stabilizer, wherein one of the first and second stabilizers has a shaft having a semi-cylindrical shape, and other has a bearing part having a semi-circular shaped groove and wherein the semi-circular groove does not pass through, in a depth direction of the semi-circular groove, a member on which the semi-circular groove is formed and which is a part of the first stabilizer and the second stabilizer.

5. The key switch according to claim 4, wherein at least one of the first and second stabilizers has a substantially U-shape in cross section thereof.

6. The key switch according to claim 4, wherein one of the first stabilizer and the second stabilizers has a substantially U-shape in cross section thereof, and other has an opening therein.

7. The key switch according to claim 4, wherein the key top has locking hooks on a back face thereof, and the first and second stabilizers each has locking pins to engage with the locking hooks.

8. The key switch according to claim 4, wherein the key switch has locking hooks on a support plate thereof, one of the first and second stabilizers has locking pins to engage with the locking hooks on the support plate, and other has slide pins to be guided through slide grooves on the support plate.

9. The key switch according to claim 4, wherein at least one of the shaft and the bearing part has grooves on a surface thereof.

10. A key switch, comprising:

a key top; and a guiding and supporting mechanism for guiding and supporting the key top, wherein the guiding and supporting mechanism has a mechanism that a substantially ring-shaped stabilizer and a substantially U-shaped stabilizer are pivotally connected by a shaft and a bearing part each having a semi-circular shape in cross section, wherein the shaft has a semi-cylindrical shape and the bearing part has a semi-circular groove, and wherein when the key top is not pushed down, a part of the shaft is positioned outside the semi-circular groove.

11. A key switch, comprising:

a key top; and a guiding and supporting mechanism for guiding and supporting the key top comprising a first stabilizer and a second stabilizer, wherein one of the first and second stabilizers has a shaft having a semi-cylindrical shape, and other has a bearing part having a semi-circular shaped groove, and wherein when the key top is not pushed down, a part of the shaft is positioned outside the semi-circular groove.

* * * * *